US009879859B2

(12) United States Patent
Kusachi et al.

(10) Patent No.: US 9,879,859 B2
(45) Date of Patent: Jan. 30, 2018

(54) COMBUSTION APPARATUS SUPPLYING COMBUSTION AIR VIA SUCTION TYPE FAN AND METHOD FOR CONTROLLING THE SAME

(71) Applicant: NORITZ CORPORATION, Hyogo (JP)

(72) Inventors: Rena Kusachi, Kobe (JP); Daisuke Konishi, Akashi (JP); Kenichi Nakayama, Akashi (JP)

(73) Assignee: NORITZ CORPORATION, Hyogo (JP)

( * ) Notice: Subject to any disclaimer, the term of this patent is extended or adjusted under 35 U.S.C. 154(b) by 397 days.

(21) Appl. No.: 14/806,402

(22) Filed: Jul. 22, 2015

(65) Prior Publication Data

US 2016/0076768 A1 Mar. 17, 2016

(30) Foreign Application Priority Data

Sep. 12, 2014 (JP) ..... 2014-186580

(51) Int. Cl.

| | |
|---|---|
| ***F23N 1/02*** | (2006.01) |
| ***F23N 1/04*** | (2006.01) |
| ***F23C 7/00*** | (2006.01) |
| ***F23L 17/00*** | (2006.01) |
| ***F23N 5/24*** | (2006.01) |

(52) U.S. Cl.

CPC ..... *F23N 1/042* (2013.01); *F23C 7/008* (2013.01); *F23L 17/005* (2013.01); *F23N 5/242* (2013.01); *F23N 2033/04* (2013.01); *F23N 2033/08* (2013.01)

(58) Field of Classification Search

CPC ..... F23N 5/242; F23N 1/042; F23N 1/022; F23N 3/082; F23C 7/008

See application file for complete search history.

(56) References Cited

FOREIGN PATENT DOCUMENTS

| | | | |
|---|---|---|---|
| JP | 53-18642 | U | 2/1978 |
| JP | 11-326402 | A | 11/1999 |
| JP | 2010-185604 | A | 8/2010 |
| JP | 4656442 | B2 | 3/2011 |

OTHER PUBLICATIONS

An Office Action issued by the Japanese Patent Office dated Oct. 27, 2015, which corresponds to Japanese Patent Application No. 2014-186580 and is related to U.S. Appl. No. 14/806,402; with English language translation.

*Primary Examiner* — Jason Lau

(74) *Attorney, Agent, or Firm* — Studebaker & Brackett PC

(57) ABSTRACT

In a suction fan type combustion apparatus, when an air supply/exhaust path of a combustion and heating unit is clogged, a combustion fan has a degraded fan current for the same fan rotation speed. Furthermore, the suction fan type configuration has the combustion and heating unit's internal pressure reduced as the combustion fan rotates faster. A combustion burner supplies fuel gas with a pressure applied thereto, which is regulated by a gas proportional valve. A degree of opening of the gas proportional valve is corrected in a direction allowing the pressure to be reduced, in accordance with a rate of degradation of a fan current relative to a reference current following a reference current characteristic. This control for correction is done with the fan current degradation rate smoothed (or low-pass filtered) in a time base direction.

9 Claims, 6 Drawing Sheets

COMBUSTION APPARATUS SUPPLYING COMBUSTION AIR VIA SUCTION TYPE FAN AND METHOD FOR CONTROLLING THE SAME

BACKGROUND OF THE INVENTION

Field of the Invention

The present invention relates to a combustion apparatus, and more specifically to a combustion apparatus configured to supply combustion air from outside a combustion chamber thereinto as a combustion fan draws the air internal to the combustion chamber.

Description of the Background Art

A combustion apparatus of a type combusting an air-fuel mixture of combustion air supplied by a fan motor and gas or a similar fuel maintains a satisfactory combustion state by controlling an air fuel mixture ratio (or an air fuel ratio) to have a prescribed proper value. Generally, depending on the quantity of heat requested to be generated, the quantity of fuel is controlled, and depending on the quantity of fuel as controlled, a combustion fan is controlled in rotation speed to maintain a proper air fuel ratio.

With combustion thus controlled, Japanese Patent No. 4656442 discloses controlling a forced air supply type combustion apparatus for maintaining a proper combustion state when the combustion apparatus has an air supply/exhaust path clogged. According to Japanese Patent No. 4656442, when the air supply/exhaust path is clogged to an increased degree, a gas proportional valve is energized with an increased current for correction to prevent gas from being supplied in a reduced quantity. According to Japanese Patent No. 4656442, when the combustion fan has a constant rotation speed, and the air supply/exhaust path is clogged to an increased degree, the fan current increases, and this phenomenon is exploited to calculate from the fan rotation speed and the fan current to what degree the air supply/exhaust path is clogged.

SUMMARY OF THE INVENTION

Japanese Patent No. 4656442 describes a configuration allowing air to be forced into a combustion chamber (or a combustion housing) as a combustion fan rotates (hereafter also referred to as a "forced draft fan type"). Japanese Patent No. 4656442 describes that when a combustion apparatus of the forced draft fan type has an air supply/exhaust path clogged, the combustion apparatus has an increased internal pressure, and accordingly, in response to the air supply/exhaust path being clogged to an increased degree, as calculated based on the fan rotation speed and the fan current, the gas proportional valve is controlled to have an increased degree of opening for correction.

In contrast, a combustion apparatus of a different manner configured to supply combustion air from outside a combustion chamber thereinto as a combustion fan draws the air internal to the combustion chamber (hereafter also referred to as a "suction fan type") is different in configuration from the combustion apparatus of the forced draft type described in Japanese patent No. 4656442, and the former may be different from the latter in how its internal pressure behaves when the air supply/exhaust path is clogged.

Furthermore, according to Japanese Patent No. 4656442, whether to control the gas proportional valve for correction (or whether to turn on/off controlling it for correction) is determined based on to what degree the air supply/exhaust path is clogged, as calculated. However, the actual fan current varies relatively sensitively, and it is difficult to quantitatively evaluate from the fan current to what degree the air supply/exhaust path is clogged and set an amount of correction corresponding thereto. This is because a quantity of heat requested to be generated, i.e., a fuel quantity, is set based on the flow rate of a medium to be heated in the combustion apparatus, and the fuel quantity varies as a flow rate sensor senses a varying value, the user adjusts the flow rate minutely, and/or the like, and accordingly, to provide a balanced air fuel ratio, the fan rotation speed will also minutely vary, and consequently, the fan current will also vary.

Thus, when the suction fan type combustion apparatus is controlled exactly as described in Japanese patent No. 4656442, the combustion apparatus may not be able to maintain a satisfactory combustion state.

The present invention has been made to address the above issue, and contemplates allowing a suction fan type combustion apparatus to maintain a satisfactory fuel combustion state while the combustion apparatus has an air supply/exhaust path clogged.

The present invention in one aspect provides a combustion apparatus comprising: a combustion mechanism, a combustion and heating unit having the combustion mechanism stored therein; a combustion fan; a regulating valve; a rotation speed detector; a current detector; and a control device for controlling the combustion mechanism, the combustion fan, and the regulating valve. The combustion mechanism is configured to combust a mixture of air and fuel to generate combustion heat. The combustion fan is configured to draw a quantity of air that corresponds to a rotation speed thereof from inside the combustion and heating unit to supply air to the combustion mechanism through an opening provided at the combustion and heating unit. The regulating valve is configured to control in accordance with a degree of opening thereof a supply pressure of the fuel through the combustion mechanism. The rotation speed detector detects the rotation speed of the combustion fan. The current detector detects a current of a fan motor that rotates the combustion fan. The control device includes a gas quantity control unit and a combustion fan control unit. The gas quantity control unit is configured to be operative in response to a quantity of heat that is requested to be generated from the combustion mechanism, to control a quantity of fuel to be supplied through the combustion mechanism. The combustion fan control unit is configured to control the combustion fan to attain a rotation speed corresponding to the quantity of fuel to be supplied that is set to correspond to the quantity of heat requested to be generated. The gas quantity control unit has a pressure regulation unit configured to control the regulating valve in degree of opening in accordance with a set value of the quantity of fuel to be supplied that corresponds to the quantity of heat requested to be generated. The pressure regulation unit has a current degradation rate calculation unit and a degree-of-opening correction unit. The current degradation rate calculation unit is configured to calculate a degradation rate of a fan current value detected by the current detector relative to a reference current value that is obtained from the rotation speed at present of the combustion fan, through a smoothing process performed in a time base direction, by following a predetermined reference current characteristic between the rotation speed of the combustion fan and the current of the fan motor. The degree-of-opening correction unit is configured to correct, in a direction allowing the pressure to be reduced, the degree of opening of the regulating valve that corresponds to the same set value of the quantity of fuel to be supplied, depending on the current degradation rate calculated by the current degradation rate calculation unit.

The present invention in another aspect provides a method for controlling a combustion apparatus including a combustion mechanism combusting an air fuel mixture of fuel supplied with a pressure applied thereto that is regulated in accordance with a degree of opening of a regulating valve and combustion air supplied via a combustion fan of a suction type fan, the method comprising the steps of: controlling, by a control unit, the combustion fan to attain a rotation speed corresponding to a quantity of fuel to be supplied that is set to correspond to a quantity of heat requested to be generated from a combustion mechanism; and controlling, by the control unit, the regulating valve in degree of opening in accordance with a set value of the quantity of fuel to be supplied that corresponds to the quantity of heat requested to be generated. The step of controlling the regulating valve includes the steps of detecting a rotation speed of the combustion fan and a current of a fan motor that rotates the combustion fan, based on an output of a detector provided at the combustion fan; calculating a degradation rate of a detected fan current value relative to a reference current value, that is obtained from the rotation speed at present of the combustion fan, through a smoothing process performed in a time base direction, in accordance with a predetermined reference current characteristic between the rotation speed of the combustion fan and the current of the fan motor; and correcting, in a direction allowing the pressure to be reduced, the degree of opening of the regulating valve that corresponds to the same set value of the quantity of fuel to be supplied, depending on the calculated current degradation rate.

When the present combustion apparatus and method for controlling the same, with a suction type fan, has an air supply/exhaust path clogged and accordingly has a degraded fan current (i.e., a reduced quantity of air), a fan current degradation rate can be referred to for correcting a regulating valve's degree of opening in a direction allowing fuel to be supplied with a reduced pressure applied thereto to maintain a balanced air fuel ratio. Thus, if the air supply/exhaust path is clogged, the combustion apparatus can maintain a satisfactory fuel combustion state. The smoothing process (or low-pass filtering process) allows the fan current degradation degree (or rate) to be referred to for quantitatively evaluating to what degree the air supply/exhaust path is clogged, without causing a destabilized combustion state.

Thus a major advantage of the present invention resides in allowing a suction fan type combustion apparatus to maintain a satisfactory fuel combustion state while the combustion apparatus has an air supply/exhaust path clogged.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Hereinafter, an embodiment of the present invention will specifically be described with reference to the drawings. Note that in the figures, identical or corresponding components are identically denoted and will in principle not be described repeatedly.

Figure 1:
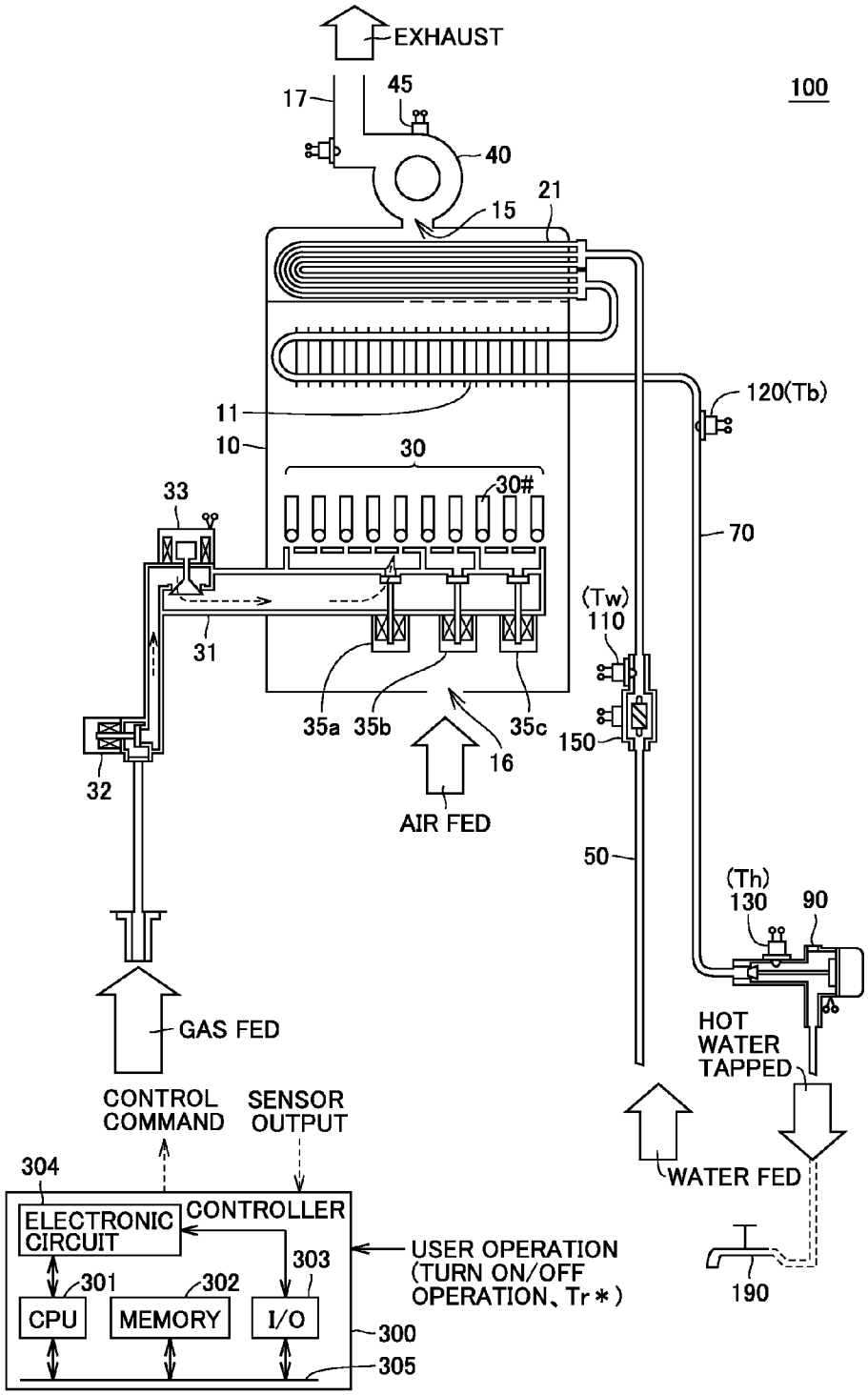
FIG. 1 schematically shows a configuration of a water heater having a combustion apparatus applied thereto according to an embodiment of the present invention.

FIG. 1 schematically shows a configuration of a water heater having a combustion apparatus applied thereto according to an embodiment of the present invention.

With reference to FIG. 1, a water heater 100 includes a combustion and heating unit 10 having a primary heat exchanger 11, a secondary heat exchanger 21, and a combustion burner 30 housed therein, a combustion fan 40, a water inlet pipe 50, a hot water delivery pipe 70, and a controller 300. Combustion and heating unit 10 can be configured to delimit equipment involved in combustion and heating from the surroundings by a casing for housing primary heat exchanger 11, secondary heat exchanger 21, and combustion burner 30. Although not shown in the figure, a casing is further provided for housing the entire configuration of water heater 100 including controller 300 and combustion and heating unit 10.

Water inlet pipe 50 receives unheated water, such as tap water, as a medium to be heated. Water inlet pipe 50 is provided with a temperature sensor 110. Temperature sensor 110 senses temperature Tw of unheated water (hereinafter also referred to as inflow water temperature Tw).

A flow rate sensor 150 is disposed at water inlet pipe 50 and senses the flow rate of the water passing through the pipe. Flow rate sensor 150 senses a flow rate Q, which is indicative of a rate of a flow passing through heat exchangers 11, 21 (i.e., a storage water heater body flow rate). Flow rate sensor 150 is configured for example as an impeller type flow rate sensor.

Water inlet pipe 50 delivers unheated water which is in turn initially preheated by the secondary heat exchanger and thereafter mainly heated by primary heat exchanger 11. Hot water heated to a prescribed temperature by primary heat exchanger 11 and secondary heat exchanger 21 is output through hot water delivery pipe 70. Accordingly, water heater 100 supplies high temperature hot water (or heated water) from heat exchangers 11 and 21 to a hot water tap 190 in a kitchen, a bathroom, and the like, a prescribed location such as a circuit supplying hot water to a bath (not shown), and the like.

Hot water delivery pipe 70 is provided with a flow regulating valve 90 and temperature sensors 120, 130. Temperature sensor 120 is disposed near heat exchanger 21 and senses temperature of hot water output from heat exchangers 11 and 21 (hereafter also referred to as storage water heater body temperature Tb). Temperature sensor 130 is provided near flow regulating valve 90 and senses temperature of hot water tapped from water heater 100 (hereafter also referred to tapping temperature Th). Flow regulating valve 90 is provided to control tapped hot water in flow rate. For example, immediately after combustion is started, or while the water heater is operated at a maximum tolerable flow rate or the like and accordingly its heating ability is insufficient, or the like, the tapped hot water can be reduced in flow rate by controlling flow regulating valve 90 in degree of opening to thus avoid having tapping temperature Th dropped.

Combustion and heating unit 10 having combustion burner 30 housed therein is provided with an exhaust port 15 and an air feed port 16. Combustion burner 30 is formed of a plurality of burners 30#. Combustion fan 40 is disposed to correspond to exhaust port 15. When combustion fan 40 is actuated, it draws the air internal to combustion and heating unit 10 (i.e., exhaust gas generated after combustion) through exhaust port 15 and guides the air to an exhaust path 17. In contrast, air feed port 16 introduces external air from outside combustion and heating unit 10 thereinto. In other words, the combustion apparatus applied to water heater 100 has a so-called suction fan type configuration, and supplies external air through air feed port 16 into combustion and heating unit 10 as combustion air as combustion fan 40 is actuated.

In combustion and heating unit 10, combustion burner 30 outputs fuel gas which is in turn mixed with combustion air introduced by combustion fan 40. An igniter (not shown) ignites the air-fuel mixture to combust the combustion gas and as a result generate a flame. The flame from combustion burner 30 generates combustion heat which is provided within combustion and heating unit 10 to primary heat exchanger 11 and secondary heat exchanger 21.

Primary heat exchanger 11 uses sensible heat obtained from the combustion gas output from combustion burner 30 and combusted (i.e., combustion heat) to heat the unheated water that is received from water inlet pipe 50 by heat exchange. Secondary heat exchanger 21 uses latent heat obtained from the combustion gas output from combustion burner 30, and combusted and exhausted, to heat unheated water that passes therethrough by heat exchange. The combusted and exhausted gas after the heat exchange is emitted through exhaust port 15 to exhaust path 17 as combustion fan 40 is operated. Thus, the operation of combustion fan 40 allows the combusted and exhausted gas and the combustion air to be exhausted and fed, respectively, integrally.

Combustion burner 30 is supplied with gas through a gas supply pipe 31 provided with a main gas solenoid valve 32, a gas proportional valve 33, and power switching valves 35*a* to 35*c*. Main gas solenoid valve 32 has a function to turn on and off supplying fuel gas to combustion burner 30. Gas supply pipe 31 supplies fuel gas to combustion burner 30 with a pressure (hereafter also referred to as a "gas pressure") applied as controlled depending on to what degree gas proportional valve 33 is opened.

Power switching valves 35*a* to 35*c* are opened/closed as controlled to switch how many burners 30# should supply fuel gas therethrough. The combustion apparatus as a whole generates a quantity of heat, which is proportional to a quantity of gas supplied from combustion burner 30, that is determined by a combination of the number of burners supplying gas and a gas pressure. Accordingly, corresponding to a quantity of heat requested to be generated, a setting map can previously be created to determine a combination of a pattern of opening and closing power switching valves 35*a* to 35*c* (or how many burners are operated) and to what degree gas proportional valve 33 is opened (or gas pressure). Note that while strictly speaking, a quantity of gas supplied corresponds to a quantity thereof supplied per unit time (i.e., a flow rate), hereinafter it will be referred to simply as a "quantity of gas supplied" or the like.

Combustion fan 40 supplies air in a quantity controlled to maintain a ratio of the air and the quantity of gas supplied from combustion burner 30 at a prescribed value (e.g., an ideal air fuel ratio). Combustion fan 40 supplies air in a quantity proportional to the fan rotation speed. Accordingly, combustion fan 40 has a rotation speed controlled in accordance with a target rotation speed set depending on how the quantity of gas supplied varies. Combustion fan 40 is provided with a rotation speed sensor 45 for sensing the fan rotation speed.

Controller 300 includes a central processing unit (CPU) 301, a memory 302, an input/output (I/O) circuit 303, and an electronic circuit 304. CPU 301, memory 302, and I/O circuit 303 can communicate signals with one another via a bus 305. Electronic circuit 304 is configured to perform a prescribed operation processing by dedicated hardware. Electronic circuit 304 can communicate signals with CPU 301 and I/O circuits 303.

Controller 300 operates to receive via I/O circuit 303 a signal output from each sensor (or a value sensed thereby) and a user operation and also generates a control command issued to each device to generally control the operation of water heater 100. The user operation includes a command to turn on/off operating water heater 100, and a set hot water temperature (Tr*) command. The control command includes a command to open/close each valve, a degree-of-opening command, and a control command issued to combustion fan 40.

In water heater 100, when the command to operate water heater 100 is turned on, controller 300 turns on a combustion operation in combustion and heating unit 10 in response to flow rate sensor 150 sensing flow rate Q exceeding a minimum operation flow rate (MOQ). Once the combustion operation has been started, main gas solenoid valve 32 is opened to start supplying combustion burner 30 with fuel gas.

Thus, water heater 100 can have combustion and heating unit 10 provided with exhaust port 15 and air feed port 16, combustion burner 30, gas supply pipe 31, main gas solenoid valve 32, gas proportional valve 33, power switching valves 35*a* to 35*c*, combustion fan 40, and controller 300 to configure the combustion apparatus according to the present embodiment. In other words, combustion burner 30 corresponds to a "combustion mechanism," gas proportional valve 33 corresponds to a "regulating valve," and controller 300 corresponds to a "control device."

Figure 2:
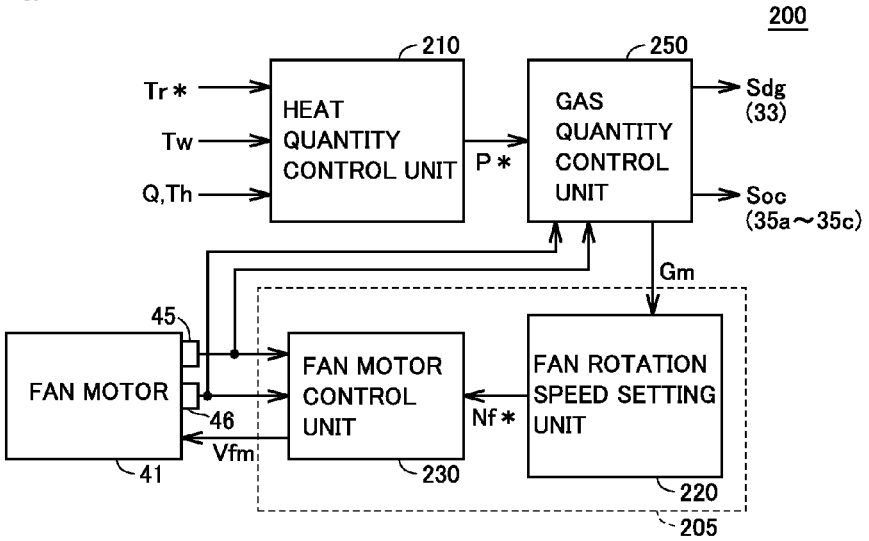
FIG. 2 is a functional block diagram for illustrating how combustion is controlled in the combustion apparatus for controlling temperature of tapped hot water in the water heater shown in FIG. 1.

FIG. 2 is a functional block diagram for illustrating how combustion is controlled in the combustion apparatus for controlling temperature of tapped hot water in water heater 100 shown in FIG. 1. Note that in the following functional block diagrams including FIG. 2, each block represents a function implemented by hardware processing in controller 300 by electronic circuit 304 and/or software processing done as CPU 301 executes a program previously stored in memory 302 for the sake of illustration.

With reference to FIG. 2, a temperature control unit 200 controls tapping temperature Th according to set hot water temperature Tr*. Temperature control unit 200 includes a combustion fan control unit 205, a heat quantity control unit 210, and a gas quantity control unit 250. Combustion fan control unit 205 has a fan rotation speed setting unit 220 and a fan motor control unit 230.

Heat quantity control unit 210 uses tapping temperature Th (from temperature sensor 130), inflow water temperature Tw (from temperature sensor 110), set hot water temperature Tr*, and flow rate Q (from flow rate sensor 150) to calculate a quantity of heat requested to be generated P* indicating a quantity of heat that the combustion apparatus is requested to generate. Specifically, heat quantity control unit 210 calculates the quantity of heat that the combustion apparatus is requested to generate P* from flow rate Q and an amount of rise in temperature ΔT ($P^*=Q\cdot\Delta T$).

For example, quantity of heat requested to be generated P* can be calculated via setting amount of rise in temperature ΔT to be equal to Tr* minus Tw to control tapping temperature Th to set hot water temperature Tr*. In doing so, how tapping temperature Th deviates (i.e., Tr*−Th) can be reflected in amount of rise in temperature ΔT to provide feedback control.

Gas quantity control unit 250 controls gas proportional valve 33 and power switching valves 35*a* to 35*c*, based on quantity of heat requested to be generated P* as calculated by heat quantity control unit 210. Specifically, command Sdg for degree of opening of gas proportional valve 33, and a command Soc to open/close power switching valves 35*a* to 35*c* are generated.

Figure 3:
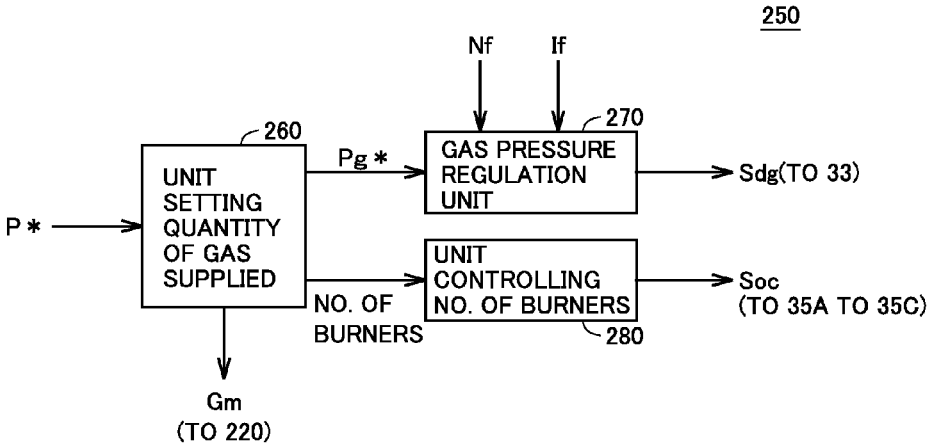
FIG. 3 is a functional block diagram for further illustrating in configuration a gas quantity control unit shown in FIG. 2.

FIG. 3 is a functional block diagram for further illustrating gas quantity control unit 250 in configuration.

With reference to FIG. 3, gas quantity control unit 250 includes a unit setting the quantity of gas supplied 260, a gas pressure regulation unit 270, and a unit controlling the number of burners 280.

Unit setting the quantity of gas supplied 260 sets a quantity of gas to be supplied Gm that combustion burner 30 supplies, based on quantity of heat requested to be generated P* as calculated by heat quantity control unit 210. Furthermore, unit setting the quantity of gas supplied 260 determines such a combination of a number of burners and a gas pressure (or a target gas pressure Pg*) that achieves quantity of gas to be supplied Gm. For example, corresponding to quantity of heat requested to be generated P*, a setting map is previously created to determine a combination of a pattern of opening and closing power switching valves 35*a* to 35*c* (or how many burners are operated) and target gas pressure Pg*. Gas quantity control unit 250 follows the map to set the number of burners and target gas pressure Pg* corresponding to quantity of gas to be supplied Gm (or quantity of heat requested to be generated P*).

Unit controlling the number of burners 280 outputs command Soc to open/close power switching valves 35*a* to 35*c* in accordance with the number of burners as set by unit setting the quantity of gas supplied 260. In response to command Soc, power switching valves 35*a* to 35*c* are opened/closed, as controlled, to allow fuel gas to be supplied through combustion burner 30 in accordance with the number of burners set by unit setting the quantity of gas supplied 260.

Gas pressure regulation unit 270 generates command Sdg for a degree of opening of gas proportional valve 33 in accordance with target gas pressure Pg* set by unit setting the quantity of gas supplied 260. A current that drives gas proportional valve 33 is controlled in response to degree-of-opening command Sdg to allow gas proportional valve 33 to have a degree of opening adjusted in accordance with degree-of-opening command Sdg. As gas proportional valve 33 is adjusted in degree of opening, gas supply pipe 31 supplies combustion burner 30 with gas with adjusted pressure applied thereto.

Figure 4:
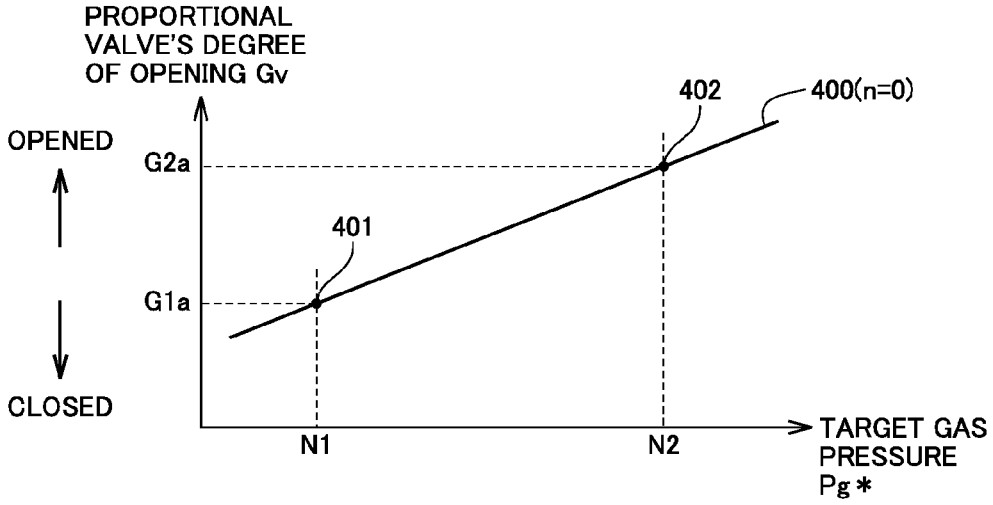
FIG. 4 is a conceptual representation for illustrating how a gas pressure regulation unit shown in FIG. 3 controls a gas proportional valve in degree of opening.

FIG. 4 is a conceptual representation for illustrating how gas pressure regulation unit 270 controls the gas proportional valve in degree of opening.

With reference to FIG. 4, a reference characteristic in degree of opening 400 defining gas proportional valve 33 in degree of opening relative to target gas pressure Pg* is previously determined in accordance with a correspondence of gas proportional valve 33 in degree of opening to pressure applied to supply gas. Reference characteristic in degree of opening 400 can be determined from a specification of components, an experiment via a real machine, and/or the like.

Reference characteristic in degree of opening 400 can be applied to set a degree of opening of gas proportional valve 33 to achieve target gas pressure Pg* set by unit setting the quantity of gas supplied 260 (Hereinafter this degree of opening will also be referred to as the proportional valve's degree of opening Gv). For example, for Pg*=N1, Gv=G1*a* (a characteristic point 401), and for Pg*=N2, Gv=G2*a* (a characteristic point 402). Using two characteristic points 401 and 402 to determine reference characteristic in degree of opening 400 allows linear interpolation to be used to obtain the proportional valve's degree of opening Gv for any target gas pressure Pg*. Gas pressure regulation unit 270 generates command Sdg for a degree of opening of gas proportional valve 33 in response to the proportional valve's degree of opening Gv as obtained.

Degree-of-opening command Sdg as described above and command Soc to open/close the power switching valves allow gas proportional valve 33 and power switching valves 35*a* to 35*c* to be controlled to allow combustion burner 30 to supply a quantity of gas that matches quantity of heat requested to be generated P* (i.e., quantity of gas to be supplied Gm).

Again, with reference to FIG. 2, fan rotation speed setting unit 220 sets a rotation speed control value Nf* for combustion fan 40 in accordance with quantity of gas to be supplied Gm as set by gas quantity control unit 250. As has been set forth above, rotation speed control value Nf* is set such that when combustion burner 30 outputs quantity of gas to be supplied Gm combustion fan 40 supplies a quantity of air that is required to maintain a prescribed air fuel ratio. For example, it is possible to previously create a setting map associating quantity of gas to be supplied Gm with rotation speed control value Nf*.

Fan motor control unit 230 refers to a fan rotation speed that is sensed by rotation speed sensor 45 to match an actual fan rotation speed Nf to rotation speed control value Nf* by controlling voltage Vfm supplied to fan motor 41 for rotating and thus driving combustion fan 40.

For example, when fan motor 41 is a direct current (DC) motor, voltage Vfm is a level variable dc voltage or a duty variable, pulsing voltage. Voltage Vfm is set by a feed forward control based on rotation speed control value Nf* and/or a feedback control based on a deviation of fan rotation speed Nf from rotation speed control value Nf*. Furthermore, a current sensor 46 is provided for sensing a current of fan motor 41 (or a fan current If). Rotation speed sensor 45 corresponds to a "rotation speed detector," and current sensor 46 corresponds to a "current detector."

By controlling the fan rotation speed as described above, the quantity of gas supplied through combustion burner 30 and the quantity of combustion air supplied as combustion fan 40 operates can be controlled to maintain an appropriate ratio (air fuel ratio) to allow combustion burner 30 to present a satisfactorily maintained combustion state. The controlling process done by combustion fan control unit 205 as described above corresponds to one embodiment of a process done by "the step of controlling the combustion fan to attain a rotation speed."

Figure 5:
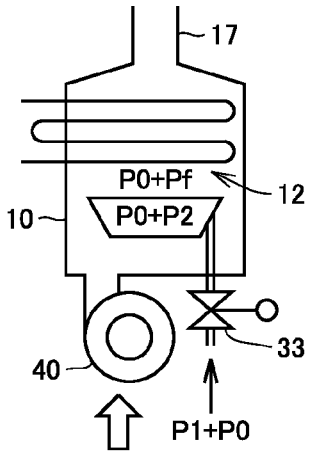
FIG. 5 is a conceptual representation for illustrating a relationship in pressure in a combustion and heating unit involved in supplying fuel gas in a forced draft fan type combustion apparatus shown as a comparative example.
Figure 6:
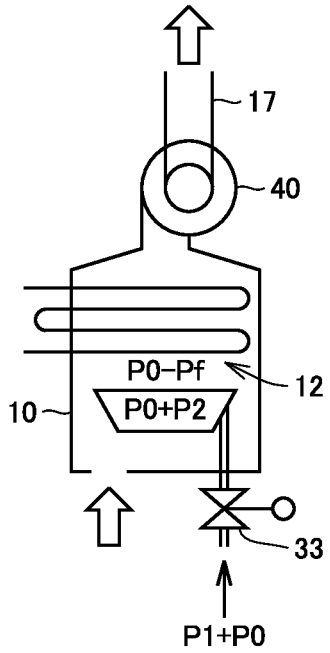
FIG. 6 is a conceptual representation for illustrating a relationship in pressure in a combustion and heating unit involved in supplying fuel gas in a suction fan type combustion apparatus having the present embodiment applied thereto.

Hereinafter will be discussed a behavior presented when combustion and heating unit 10 has the air supply/exhaust path clogged. Initially, to discuss pressure variation caused when the air supply/exhaust path is clogged, reference will be made to FIGS. 5 and 6 to describe a relationship in pressure involved in supplying fuel gas in combustion and heating unit 10. FIG. 5 represents a relationship in pressure in combustion and heating unit 10 in a forced draft fan type combustion apparatus similar to Japanese patent No. 4656442 and shown as a comparative example, and FIG. 6 represents a relationship in pressure in combustion and heating unit 10 in a suction fan type combustion apparatus having the present embodiment applied thereto.

With reference to FIG. 5, when main gas solenoid valve 32 is opened, atmospheric pressure P0 plus fuel gas's initial pressure P1 (i.e., P0+P1) is applied to supply the fuel gas to gas proportional valve 33. Gas proportional valve 33 controlled in degree of opening provides a regulated gas pressure, i.e., gas proportional valve 33 outputs gas with a pressure represented as (P0+P2). Pressure P2 is regulated depending on the proportional valve's degree of opening Gv.

In the forced draft fan type combustion apparatus, when a pressure acting in combustion and heating unit 10 as combustion fan 40 operates is represented as Pf, the combustion and heating unit has an internal pressure represented as (P0+Pf). Combustion burner 30 supplies gas in a quantity increasing/decreasing depending on a pressure difference between output gas pressure (P0+P2) and the combustion and heating unit's internal pressure (P0+Pf). In other words, combustion burner 30 supplies gas in a quantity increasing to be larger for a pressure difference (P2−Pf) having larger values.

As such, when combustion fan 40 is rotated faster, the combustion and heating unit has its internal pressure increased and pressure difference (P2−Pf) decreases. It is thus understood that combustion burner 30 supplies gas in a quantity reduced for the same degree of opening GV of the proportional valve (pressure P2).

When combustion and heating unit 10 has the air supply/exhaust path clogged, a load of combustion fan 40 decreases, and combustion fan 40 consumes reduced power (i.e., fan current If) for the same fan rotation speed. In that case, if a fan rotation speed is controlled in accordance with rotation speed control value Nf* set in accordance with a characteristic presented when the air supply/exhaust path is not clogged, combustion fan 40 actually supplies a reduced quality of air. This may result in an increased air fuel ratio (or insufficient combustion air) and hence a poor combustion state.

Accordingly, as is also described in Japanese patent No. 4656442, when a forced draft fan type combustion apparatus has an air supply/exhaust path clogged, combustion fan 40 is controlled to rotate faster to introduce more combustion air to maintain an appropriate air fuel ratio.

As has been set forth above, as the fan rotates faster, the combustion and heating unit has its internal pressure increased and the combustion burner supplies gas in a reduced quantity for the same degree of opening of the proportional valve. Accordingly, as described in Japanese Patent No. 4656442, when the air supply/exhaust path is clogged to a degree exceeding a prescribed level, the gas proportional valve can be energized with an increased current for correction to prevent the combustion burner from supplying a reduced quantity of gas. Thus when the air supply/exhaust path is clogged, the fan is controlled to rotate faster to introduce an increased quantity of air. Furthermore, preventing the combustion burner from supplying gas in a reduced quantity as the fan is controlled to rotate faster can resolve an increased air fuel ratio (or insufficient combustion air).

With reference to FIG. 6, the suction type combustion apparatus, as well as the FIG. 5 combustion apparatus, has gas proportional valve 33 to allow gas to have a pressure regulated in accordance with the proportional valve's degree of opening Gv to (P0+P2). The suction fan type combustion apparatus, in contrast, has the combustion and heating unit's internal pressure reduced as combustion fan 40 operates. Thus, between gas pressure (P0+P2) and the combustion and heating unit's internal pressure (P0−Pt), there will be a pressure difference of (P2+Pf). As such, when combustion fan 40 is rotated faster, pressure difference (P2+Pf) increases, and it is thus understood that combustion burner 30 supplies gas in an increased quantity for the same degree of opening GV of the proportional valve (pressure P2).

When the suction fan type combustion apparatus has the air supply/exhaust path clogged and accordingly introducing a reduced quantity of air, the suction fan type combustion apparatus, as well as the forced draft fan type combustion apparatus, supplies a reduced quantity of air for the same fan rotation speed command value. At the time, pressure difference (P2+Pf) decreases, and accordingly, the gas is also supplied in a reduced quantity for the same degree of opening of gas proportional valve 33, however, for the air fuel ratio, the quantity of air would be reduced more than the quantity of gas supplied. Furthermore, as well as the forced draft fan type combustion apparatus, controlling the fan to rotate faster to introduce an increased quantity of air would accordingly, excessively increase the quantity of gas supplied. For these grounds, it is difficult to resolve an increased air fuel ratio (or insufficient combustion air) caused in the combustion and heating unit as the air supply/exhaust path is clogged, and maintain a satisfactory combustion state. Furthermore, similarly as described in Japanese patent No. 4656442, controlling the fan to rotate faster in combination with energizing the gas proportional valve with an increased current for correction (to obtain increased gas pressure) will result in supplying gas in a further increased quantity and cannot prevent the combustion and heating unit from having an increased air fuel ratio (or insufficient combustion air) therein.

Accordingly, in the suction fan type combustion apparatus according to the present embodiment, when a fan current degraded (or a quantity of air reduced) as the air supply/exhaust path is clogged is detected, combustion burner 30 supplies gas with reduced pressure applied thereto to maintain a balanced air fuel ratio, as will more specifically be described hereinafter.

Again, with reference to FIG. 3, gas pressure regulation unit 270 further receives fan current If sensed by current sensor 46, and fan rotation speed Nf sensed by rotation speed sensor 45.

Gas pressure regulation unit 270 further has a function to sense to what degree combustion and heating unit 10 has the air supply/exhaust path clogged, based on fan current If and fan rotation speed Nf, and a function to correct the degree of opening of gas proportional valve 33 from the FIG. 4 reference characteristic in degree of opening 400, based on to what degree the air supply/exhaust path is clogged, as sensed.

Figure 7:
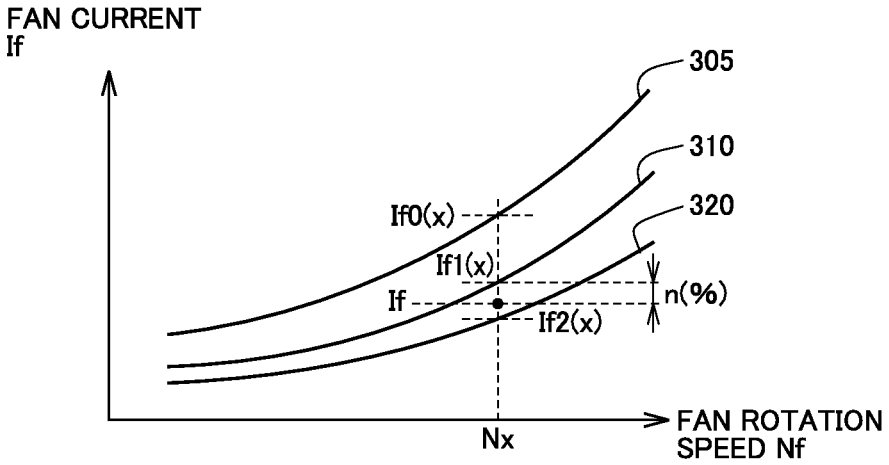
FIG. 7 is a conceptual representation for illustrating sensing to what degree the air supply/exhaust path is clogged.

FIG. 7 is a conceptual representation for illustrating sensing to what degree the air supply/exhaust path is clogged. FIG. 7 has an axis of abscissa representing fan rotation speed Nf and an axis of ordinate representing fan current If.

With reference to FIG. 7, an initial current characteristic 305 represents a relationship of fan current If with fan rotation speed Nf when combustion fan 40 is in an initial state (or unused). When soot or strong wind increases resistance in exhaust path 17 and combustion and heating unit 10 has the air supply/exhaust path accordingly clogged, a load of combustion fan 40 is reduced and fan current If decreases for the same fan rotation speed Nf. By to what degree (or in what quantity or at what rate) fan current If decreases, to what degree the air supply/exhaust path is clogged can be quantitatively detected.

FIG. 7 further represents a reference current characteristic 310 and a limiting current characteristic 320. Reference current characteristic 310 can be preset as a set of lower limit values of fan current If corresponding to fan rotation speed Nf, corresponding to a range that does not negatively affect a combustion state while the air supply/exhaust path is clogged. For example, reference current characteristic 310 can be set by regarding as the range that does not negatively affect a combustion state a range in which fan current If has a degradation rate relative to initial current characteristic 305 within a range. Note that reference current characteristic 310 can be determined as desired with initial current characteristic 305 serving as a base.

Hereinafter, If0($x$) will represent a current corresponding to a fan rotation speed Nx, that follows initial current characteristic 305, and If1($x$) will represent a current corresponding to fan rotation speed Nx, that follows reference current characteristic 310. A fan current actually sensed by current sensor 46 is represented as If.

When fan current If falls within a range above reference current characteristic 310, i.e., If>If1($x$), it is determined that the air supply/exhaust path is not clogged to have a negative effect. Thus in this range the FIG. 4 reference characteristic in degree of opening 400 is applied to set a degree of opening of gas proportional valve 33 based on target gas pressure Pg*.

When fan current If decreases to be lower than reference current If1($x$), that the air supply/exhaust path is clogged is sensed. Furthermore, as a parameter for quantitatively evaluating to what degree the air supply/exhaust path is clogged, a fan current degradation rate n (%) is calculated as indicated below:

$$n(\%)=(If1(x)-If)/If1(x)\times 100 \quad (1).$$

Note that for If≥If(1)x, n≤0(%). For If ≥If(1)x, n may equal 0(%).

Limiting current characteristic 320 is previously set as a set of current values for each fan rotation speed Nf, that presents fan current degradation rate n=α (%). A current corresponding to fan rotation speed Nx that follows limiting current characteristic 320 is represented by If2($x$).

When fan current If falls within a range below limiting current characteristic 320, i.e., If<If2($x$), the air supply/exhaust path is clogged to a degree larger than a limit and an operation to combust fuel via combustion burner 30 is prohibited. Accordingly, prescribed value α (%) is preset as appropriate through an experiment in a real machine or the like to correspond to a limit value for a degree to which the air supply/exhaust path is clogged that would make it difficult to continue a combustive operation.

In contrast, when fan current If falls within a range between reference current characteristic 310 and limiting current characteristic 320, i.e., If2($x$)≤If<If1($x$), the proportional valve's degree of opening Gv is set by correcting the degree of opening of gas proportional valve 33 relative to the proportional valve's degree of opening that follows reference characteristic in degree of opening 400 in a direction allowing the gas pressure to be reduced.

Figure 8:
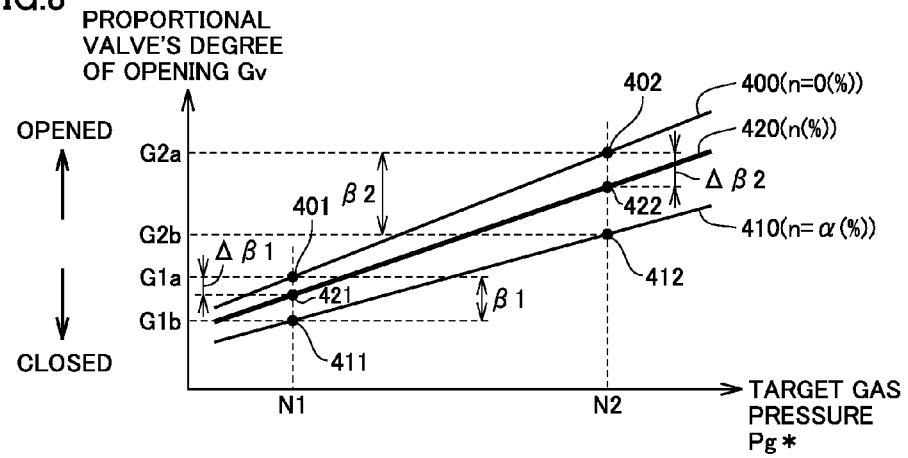
FIG. 8 is a conceptual representation for illustrating how the gas proportional valve's degree of opening is corrected to accommodate to what degree the air supply/exhaust path is clogged.

FIG. 8 is a conceptual representation for illustrating how the gas proportional valve's degree of opening is corrected to correspond to what degree the air supply/exhaust path is clogged.

With reference to FIG. 8, in addition to the FIG. 4 reference characteristic in degree of opening 400, a reference characteristic in degree of opening 410 is further determined. While reference characteristic in degree of opening 400 defines the proportional valve's degree of opening Gv corresponding to target gas pressure Pg* for n=0(%), reference characteristic in degree of opening 410 defines the proportional valve's degree of opening Gv corresponding to target gas pressure Pg* for n=α (%). Reference characteristic in degree of opening 410 can also be previously determined through an experiment in a real machine and/or the like. Reference characteristic in degree of opening 400 corresponds to a "first reference characteristic in degree of opening," and reference characteristic in degree of opening 410 corresponds to a "second reference characteristic in degree of opening."

Reference characteristic in degree of opening 410 can be defined by two characteristic points 411 and 412. Characteristic point 411, as well as characteristic point 401, determines the proportional valve's degree of opening for Pg*=N1 (i.e., Gv=G1$b$). Characteristic point 412, as well as characteristic point 402, determines the proportional valve's degree of opening for Pg*=N2 (i.e., Gv=G2$b$).

Using two characteristic points 411 and 412 to determine reference characteristic in degree of opening 410 allows linear interpolation to be used to obtain the proportional valve's degree of opening Gv for any target gas pressure Pg*. Hereafter, relative to reference characteristic in degree of opening 400, reference characteristic in degree of opening 410 has a difference in degree of opening represented as β1 (β1=G1$a$−G1$b$) for Pg*=N1 and a difference in degree of opening represented as β2 ((β2=G2$a$−G2$b$) for Pg*=N2 for the sake of illustration.

When fan current If has a degradation rate n (%) falling within 0<n≤α, a characteristic in degree of opening 420 corrected from reference characteristic in degree of opening 400 can be applied to obtain the proportional valve's degree of opening Gv corresponding to target gas pressure Pg* that allows quantity of gas to be supplied Gm (or quantity of heat requested to be generated P*). Note that when n=α (%), characteristic in degree of opening 420 matches reference characteristic in degree of opening 410.

Note that characteristic in degree of opening 420 applied in correcting a degree of opening can be defined by two characteristic points 421 and 422. Characteristic point 421, as well as characteristic point 401, defines the proportional valve's degree of opening for Pg*=N1. Characteristic point 421 relative to characteristic point 401 of reference characteristic in degree of opening 400 has a difference in degree of opening Δβ1 set, with degradation rate n (%) used, to Δβ1=β1×(n/100).

Similarly, characteristic point 422, as well as characteristic point 402, defines the proportional valve's degree of opening for Pg*=N2. Characteristic point 422 relative to characteristic point 402 of reference characteristic in degree of opening 400 has a difference in degree of opening Δβ2 set, with degradation rate n (%) used, to Δβ2=β2×(n/100).

Using two characteristic points 421 and 422 thus set to determine characteristic in degree of opening 420 applied to correct a degree of opening allows linear interpolation to be used to obtain the proportional valve's degree of opening Gv for any target gas pressure Pg*. Thus, when the air supply/exhaust path is clogged and the fan current degrades, the proportional valve's degree of opening Gv can be corrected in a direction to reduce the gas pressure to be smaller for the same target gas pressure Pg* than that applied when the proportional valve has a degree of opening following reference characteristic in degree of opening 400 normally applied (or applied when the air supply/exhaust path is not clogged). Furthermore, in what amount a degree of opening should be corrected from reference characteristic in degree of opening 400 can be adjusted in accordance with fan current degradation rate n (%), i.e., to what degree the air supply/exhaust path is clogged, as quantitatively evaluated.

Figure 9:
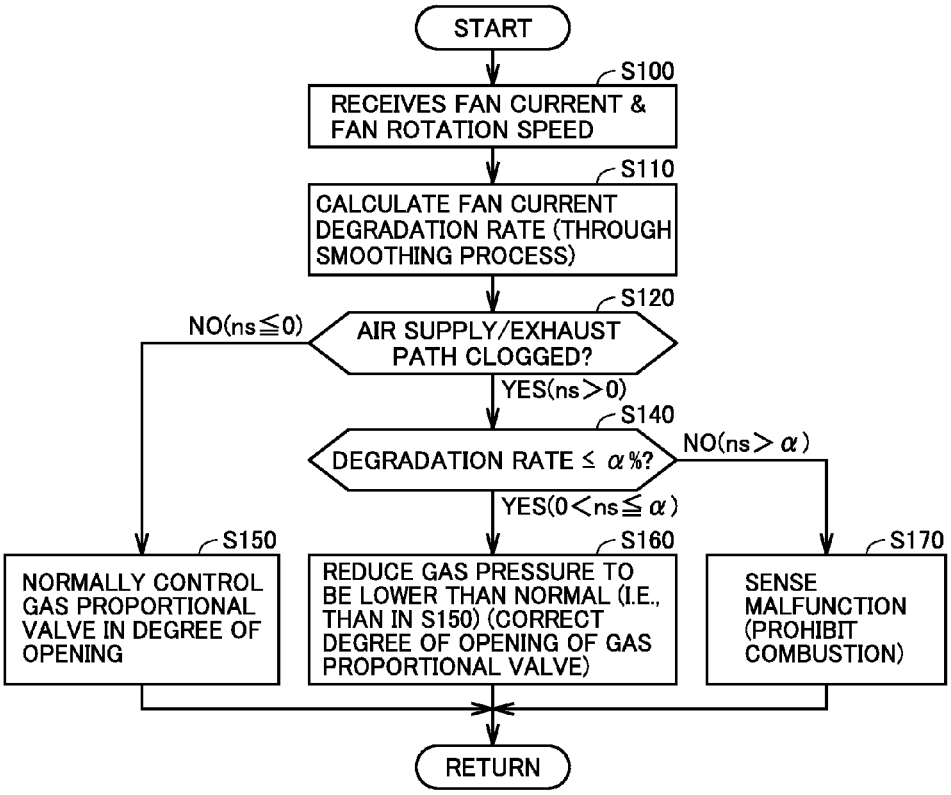
FIG. 9 is a flowchart of a control process for controlling the gas proportional valve in degree of opening in the combustion apparatus according to the present embodiment.

FIG. 9 is a flowchart of a control process for controlling the gas proportional valve in degree of opening in the combustion apparatus according to the present embodiment. The FIG. 9 process is performed repeatedly by controller 300 periodically as prescribed (e.g., whenever a period of 100 ms elapses).

With reference to FIG. 9, controller 300 in step S100 receives fan current If and fan rotation speed Nf from current sensor 46 and rotation speed sensor 45, respectively. Furthermore, controller 300 in step S110 involving a smoothing process (a low-pass filtering process) in a time base direction calculates a fan current degradation rate.

Figure 10:
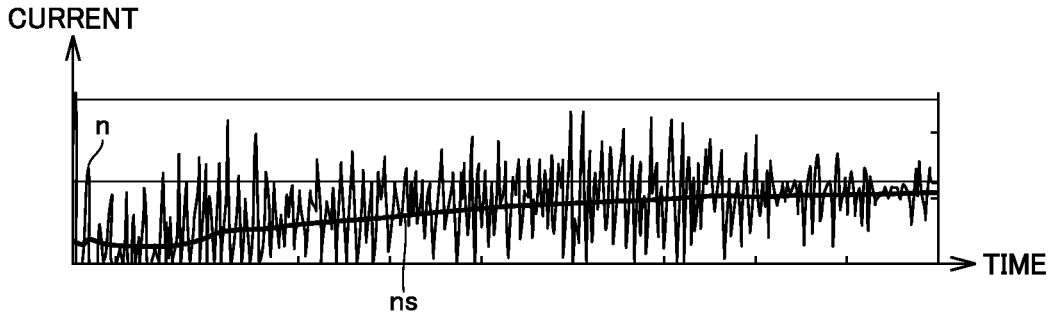
FIG. 10 represents an example of a waveform for illustrating a process for smoothing the fan current.

FIG. 10 shows an exemplary waveform of the fan current degradation rate.

With reference to FIG. 10, when a value of fan current If as sensed by current sensor 46 is used as it is, fan current degradation rate n (%) in an i-th control period, i being a natural number, is calculated as follows:

$$n(i)=(If1(i)-If(i)/If1(i)\times 100 \quad (2),$$

where n(i) represents degradation rate n (%) in the current control period, If(i) represents a value sensed by current sensor 46 in the current control period, and If1(*i*) represents a reference current on reference current characteristic 310 in the current control period, i.e., corresponding to the current fan rotation speed Nf.

Note that fan current If has a sensitively varying characteristic, since it varies as quantity of heat requested to be generated P* varies as flow rate sensor 150 senses a varying value, or the like. As such, current sensor 46 may sense a significantly varying value, i.e., degradation rate n (%) calculated directly from an instantaneous value of fan current If may significantly vary, as shown in FIG. 10. As has been set forth above, in the present embodiment, the fan current If degradation rate is referred for quantitatively evaluating to what degree the air supply/exhaust path is clogged, and if a current degradation rate based on a sensed value (or instantaneous value) of fan current If is exactly applied for control, gas proportional valve 33 will have a sensitively varying degree of opening, which may result in an unstable combustion state on the contrary. In contrast, soot or the like adhering to the air supply/exhaust path, in particular, clogs it slowly on the time base.

Accordingly, the combustion apparatus according to the present embodiment involves a smoothing process (or a low-pass filtering process) following expressions (3) and (4) in calculating a fan current degradation rate. Hereinafter, a filtered fan current degradation rate in the ith control period will be represented as ns(i):

$$ns(i)=\gamma\cdot ns(i)+(1-\gamma)\cdot n(i) \quad (3)$$

$$\gamma=L/(L+1),(1-\gamma)=1/(L+1) \quad (4).$$

L represented in expression (3) is a parameter for adjusting a time constant of the low-pass filtering process (or smoothing process). When L=0, γ=0, and n(i) is not smoothed and is thus as it is, i.e., ns(i). In contrast, when L=∞, γ=1, and ns(i) no longer varies. In other words, the larger L is, the larger time constant the low-pass filtering process has, and degradation rate ns gently varies.

As shown in FIG. 10, filtered fan current degradation rate ns calculated in accordance with expressions (2) to (4) varies to gently increase as the air supply/exhaust path is further clogged. In the present embodiment, filtered fan current degradation rate ns is applied to control gas proportional valve 33 in degree of opening for correction. Note that operational expressions (2) to (4) are only one example of the low-pass filtering (or smoothing) process, and any operational expression allowing gentle variation in the time base direction is applicable to the filtering process. Step S110 corresponds to one embodiment of a "current degradation rate calculation unit."

Again, with reference to FIG. 9, controller 300 in step S120 refers to fan current degradation rate ns as calculated in step S110 through the smoothing process to determine whether the air supply/exhaust path is clogged to a level affecting the combustion state.

For fan current degradation rate ns≤0 (NO in S120) controller 300 proceeds to step S150. In step S150, controller 300 determines that the air supply/exhaust path is not clogged to provide a reduced quantity of air, and controller 300 normally controls gas proportional valve 33 in degree of opening. In other words, the FIG. 4 reference characteristic in degree of opening 400 is applied to set a degree of opening of gas proportional valve 33 based on target gas pressure Pg* corresponding to quantity of heat that the combustion apparatus is requested to generate P*. As described above, Step S150 is performed to control gas proportional valve 33 in degree of opening when in FIG. 7 fan current If is in a range upper than reference current characteristic 310.

In contrast, for fan current degradation rate ns>0 (YES in S120) controller 300 proceeds to step S140 to further compare degradation rate ns with prescribed value α (%).

For degradation rate ns≤α (%) (YES in S140) controller 300 proceeds to step S160. In step S160, the proportional valve's degree of opening Gv is corrected to reduce the gas pressure to be lower than in the step S150 degree-of-opening control to set a degree of opening of gas proportional valve 33. In step S160, the FIG. 8 characteristic in degree of opening 420 is applied to set a degree of opening of gas proportional valve 33 based on target gas pressure Pg* corresponding to quantity of heat that the combustion apparatus is requested to generate P*.

As has been set forth above, in what amount the proportional valve's degree of opening should be corrected relative to reference characteristic in degree of opening 400 is variably set depending on degradation rate ns, i.e., to what degree the air supply/exhaust path is clogged. Step S160 is performed to control gas proportional valve 33 in degree of opening when in FIG. 7 fan current If is in a range between reference current characteristic 310 and limiting current characteristic 320. Step S160 corresponds to one embodiment of a "degree-of-opening correction unit."

In contrast, for fan current degradation rate ns>α (%) (NO in S140) controller 300 proceeds to step S170 to prohibit an operation of combusting fuel via combustion burner 30. Step S170 is performed to prohibit combustion when in FIG. 7 fan current If is in a range lower than limiting current characteristic 320.

Thus the present embodiment provides a combustion apparatus configured with a suction type fan operated to supply combustion air and when the combustion apparatus has an air supply/exhaust path clogged and accordingly has a degraded fan current (i.e., a reduced quantity of air) a fan current degradation rate is referred to for correcting the degree of opening of gas proportional valve 33 in a direction allowing combustion burner 30 to supply gas with a reduced pressure applied thereto. This can maintain a balanced air fuel ratio, and hence a satisfactory fuel combustion state if the air supply/exhaust path is clogged. In particular, the smoothing process (or low-pass filtering process) allows fan current If degradation degree (or rate) to be referred to for quantitatively evaluating to what degree the air supply/exhaust path is clogged, without causing a destabilized combustion state, and accordingly correct the degree of opening of gas proportional valve 33 to supply gas at an adjusted pressure.

Note that while the present embodiment has been described for an example with low-pass filtering a current degradation rate calculated from a value obtained from a sensor (see expression (2)), low-pass filtering a value of a fan current as sensed by a sensor, and using the filtered fan current value to calculate a current rate, can also provide a similar effect as a matter of course. Furthermore, preferably, reference current value If1 used in calculating current degradation rate n (%) is also low-pass filtered. This is because when flow rate sensor 150 senses a varying value, quantity of heat requested to be generated P* accordingly varies, and accordingly, rotation speed control value Nf* for combustion fan 40 may vary.

Furthermore, in the present embodiment, when the air supply/exhaust path is clogged, then, to maintain a satisfactory combustion state, an actual gas pressure decreases relative to the same target gas pressure Pg* and the gas will also be supplied in a reduced quantity. This is reflected in an increase in quantity of heat requested to be generated P* by a function of heat quantity control unit 210 working to control tapping temperature Th to set hot water temperature Tr*. More specifically, when the air supply/exhaust path is clogged, heat quantity control unit 210 operates to increase quantity of heat requested to be generated P* to be larger than normal (or than when the air supply/exhaust path is no clogged) so that tapping temperature Th can appropriately be controlled while gas proportional valve 33 has a corrected degree of opening.

While the present embodiment has been described with the combustion mechanism employing a fuel of gas by way of example, the present invention is applicable to combustion apparatuses employing any fuel that is mixed with air via a proportional valve controlled to regulate pressure and also requires controlling an air fuel ratio to maintain a satisfactory combustion state.

Although the present invention has been described and illustrated in detail, it is clearly understood that the same is by way of illustration and example only and is not to be taken by way of limitation, the scope of the present invention being interpreted by the terms of the appended claims.

What is claimed is:

1. A combustion apparatus comprising:

a combustion mechanism configured to combust a mixture of air and fuel to generate combustion heat;

a combustion and heating unit having said combustion mechanism stored therein;

a combustion fan configured to draw a quantity of air that corresponds to a rotation speed thereof from inside said combustion and heating unit to supply said air to said combustion mechanism through an opening provided at said combustion and heating unit;

a regulating valve configured to control in accordance with a degree of opening thereof a supply pressure of said fuel through said combustion mechanism;

a rotation speed detector detecting said rotation speed of said combustion fan;

a current detector detecting a current of a fan motor that rotates said combustion fan; and a control device controlling said combustion mechanism, said combustion fan, and said regulating valve, said control device including a gas quantity control unit configured to be operative in response to a quantity of heat that is requested to be generated from said combustion mechanism, to control a quantity of fuel to be supplied through said combustion mechanism, and a combustion fan control unit configured to control said combustion fan to attain a rotation speed corresponding to said quantity of fuel to be supplied that is set to correspond to said quantity of heat requested to be generated, said gas quantity control unit having a pressure regulation unit configured to control said regulating valve in degree of opening in accordance with a set value of said quantity of fuel to be supplied that corresponds to said quantity of heat requested to be generated, said pressure regulation unit having a current degradation rate calculation unit configured to calculate a degradation rate of a fan current value detected by said current detector relative to a reference current value that is obtained from a rotation speed at present of said combustion fan, through a smoothing process performed in a time base direction, by following a predetermined reference current characteristic between said rotation speed of said combustion fan and said current of said fan motor, and a degree-of-opening correction unit configured to correct, in a direction allowing said supply pressure to be reduced, said degree of opening of said regulating valve that corresponds to the same set value of said quantity of fuel to be supplied, depending on a current degradation rate calculated by said current degradation rate calculation unit.

2. The combustion apparatus according to claim 1, wherein:

a first reference characteristic in degree of opening is predetermined to define a relationship between a target value of said supply pressure set to correspond to said set value of said quantity of fuel to be supplied and said degree of opening of said regulating valve, for application when said fan current is not smaller than said reference current value; and said degree-of-opening correction unit sets a correction amount in degree of opening with respect to a first reference degree of opening following said first reference characteristic in degree of opening, that is corresponds to a current target value of said supply pressure, depending on said current degradation rate obtained through said smoothing process.

3. The combustion apparatus according to claim 2, wherein said control device further includes a malfunction sensing unit prohibiting said combustion mechanism from operating when said current degradation rate obtained through said smoothing process is larger than a prescribed value.

4. The combustion apparatus according to claim 3, wherein:

a second reference characteristic in degree of opening is further predetermined to define a relationship between said target value of said supply pressure and said degree of opening of said regulating valve, for application when said current degradation rate is equal to said prescribed value; and said degree-of-opening correction unit sets said correction amount in degree of opening with respect to said first reference degree of opening in accordance with a product of said current degradation rate, and a difference in degree of opening between said first reference degree of opening and a second reference degree of opening following said second reference characteristic in degree of opening, that corresponds to said current target value of said supply pressure.

5. The combustion apparatus according to claim 1, wherein said reference current characteristic is determined to provide said reference current value to be smaller than a current value of said fan motor obtained for each rotation speed of said combustion fan in an initial state of said combustion apparatus.

6. The combustion apparatus according to claim 2, wherein said reference current characteristic is determined to provide said reference current value to be smaller than a current value of said fan motor obtained for each rotation speed of said combustion fan in an initial state of said combustion apparatus.

7. The combustion apparatus according to claim 3, wherein said reference current characteristic is determined to provide said reference current value to be smaller than a current value of said fan motor obtained for each rotation speed of said combustion fan in an initial state of said combustion apparatus.

8. The combustion apparatus according to claim 4, wherein said reference current characteristic is determined to provide said reference current value to be smaller than a current value of said fan motor obtained for each rotation speed of said combustion fan in an initial state of said combustion apparatus.

9. A method for controlling a combustion apparatus including a combustion mechanism combusting an air fuel mixture of fuel supplied with a pressure applied thereto that is regulated in accordance with a degree of opening of a regulating valve and combustion air supplied via a combustion fan of a suction type fan, the method comprising the steps of:

controlling, by a control device, said combustion fan to attain a rotation speed corresponding to a quantity of fuel to be supplied that is set to correspond to a quantity of heat requested to be generated from said combustion mechanism; and controlling, by said control device, said regulating valve in degree of opening in accordance with a set value of said quantity of fuel to be supplied that corresponds to said quantity of heat requested to be generated, the step of controlling said regulating valve including the steps of:

detecting a rotation speed of said combustion fan and a current of a fan motor that rotates said combustion fan, based on an output of a detector provided at said combustion fan, calculating a degradation rate of a detected fan current value relative to a reference current value, that is obtained from a rotation speed at present of said combustion fan, through a smoothing process performed in a time base direction, in accordance with a predetermined reference current characteristic between said rotation speed of said combustion fan and said current of said fan motor, and correcting, in a direction allowing said pressure to be reduced, said degree of opening of said regulating valve that corresponds to the same set value of said quantity of fuel to be supplied, depending on a current degradation rate as calculated.

* * * * *